US005881412A

United States Patent [19]

Ziskind

[11] Patent Number: 5,881,412

[45] Date of Patent: Mar. 16, 1999

[54] DYE SCAVENGING ARTICLE

[75] Inventor: Stephen Ziskind, Delray Beach, Fla.

[73] Assignee: Dye Magnet Industries, Deerfield Beach, Fla.

[21] Appl. No.: 88,511

[22] Filed: Jun. 1, 1998

[51] Int. Cl.[6] ..... D06F 39/00

[52] U.S. Cl. ..... 8/159; 68/13 R; 68/235 R

[58] Field of Search ..... 8/137, 150, 158, 8/159; 68/3 R, 13 R, 17 R, 17 A, 235 R

[56] References Cited

U.S. PATENT DOCUMENTS

| | | |
|---|---|---|
| 3,048,993 | 8/1962 | Lucas et al. . |
| 3,212,303 | 10/1965 | Haffner et al. . |
| 3,575,021 | 4/1971 | Bochan . |
| 3,670,530 | 6/1972 | Filipak . |
| 3,673,110 | 6/1972 | Edwards . |
| 3,694,364 | 9/1972 | Edwards . |
| 3,816,321 | 6/1974 | Kleinschmidt . |
| 3,869,069 | 3/1975 | Levey et al. . |
| 4,026,131 | 5/1977 | Dugger et al. . |
| 4,065,257 | 12/1977 | Coe et al. . |
| 4,348,293 | 9/1982 | Clarke et al. . |
| 4,380,453 | 4/1983 | Claiborne . |
| 4,494,264 | 1/1985 | Wattiez et al. ..... 68/235 R |
| 4,555,354 | 11/1985 | Clarke et al. . |
| 4,638,907 | 1/1987 | Bedenk et al. . |
| 4,740,326 | 4/1988 | Hortel et al. . |
| 4,756,037 | 7/1988 | McFayden et al. . |
| 4,835,804 | 6/1989 | Arnau-Munoz et al. . |
| 4,882,917 | 11/1989 | Mizusawa et al. . |
| 4,925,586 | 5/1990 | Baker et al. . |
| 4,969,927 | 11/1990 | Schumann et al. . |
| 5,698,476 | 12/1997 | Johnson et al. . |

*Primary Examiner*—Philip R. Coe
*Attorney, Agent, or Firm*—Lerner, David, Littenberg, Krumholz & Mentlik

[57] ABSTRACT

A dye scavenging article is provided for use in scavenging extraneous random dyes from the wash and rinse waters during a laundry process. The dye scavenging article is constructed to prevent its being entrapped or commingled with the clothing items. This construction allows the dye scavenging article to be exposed to the entire volume of wash and rinse waters during the laundry process to enhance effectiveness.

47 Claims, 4 Drawing Sheets

DYE SCAVENGING ARTICLE

BACKGROUND OF THE INVENTION

The present invention relates in general to an article for removing random dyes from laundry washing applications, and more particularly, to a dye scavenging article for scavenging extraneous random dyes from laundry washing solutions during a complete laundering cycle, including both wash and rinse waters.

Undesirable dye staining of textile articles during laundering occurs when articles which have been dyed with dyes of poor wash fastness are washed together with articles which are either undyed or with articles dyed with dyes which have adequate fastness to washing. This problem, commonly known as "fading", results in the dye of one article bleeding onto an article of another color. If dye staining or bleeding occurs, the articles affected may be rendered unsuitable for further use unless rewashed with suitable oxidizing agents, such as chlorine bleaches, so as to remove the unwanted color. Unfortunately, many types of fabrics are not suitable for treatment with harsh oxidizing agents. This problem becomes more difficult since articles from which loosely held dyes are liable to bleed are not always identified nor is it possible to predict whether a dyed fabric will exhibit adequate wash fastness merely by visual examination.

Various attempts have been made to overcome the problem of dye staining or fading. For example, Coe, et al., U.S. Pat. No. 4,065,257 discloses the use of high molecular weight polyquaternary ammonium compounds as dye staining inhibitors. The dye staining inhibitors are employed as part of the soap or detergent composition suitable for washing textile articles. In Edwards, U.S. Pat. No. 3,694,364, there is disclosed the use of tertiary polymeric amines which function as anionic dye scavengers. The polymeric amines are chemically affixed on the surface of a substrate material such as cellulosic materials, for example, cotton in any of its forms, purified cotton cellulose, cellulose sponge and the like. To affix the polymeric amines, the cotton substrate is modified by phosphorylation and chemisorption of the polymeric amine. In Edwards' related U.S. Pat. No. 3,673,110, there is disclosed the use of both the tertiary polymeric amines and quaternary ammonium compounds as the dye scavenging material. The latter Edwards Patent discloses other processes for chemically affixing the dye scavenger compounds to a cellulosic material substrate also for use in controlling undesirable random dyes in a liquid bath such as when laundering textile articles. For example, the hydroxylated surface of the cellulosic material is chemically modified to establish anionic functional groups. Each of the anionic functional groups are capable of chemically binding nitrogen compounds such as the aforementioned disclosed dye scavenger compounds.

In Kleinschmidt, U.S. Pat. No. 3,816,321 there is disclosed a dye scavenging article for scavenging anionic dyes released from dyed fabrics being laundered to prevent dye transfer during the laundry process. The dye scavenging article includes a support matrix such as a polyurethane material to which there is chemically bonded a dye scavenging compound. The dye scavenging compound includes polyquaternary ammonium compounds.

Claiborne, U.S. Pat. No. 4,380,453 discloses generally the use of N-trisubstituted ammonium-2-hydroxy-3-halopropyl compounds and salts of epoxy propyl ammonium as dye scavenger compounds. The preferred dye scavenger compound is glycidyltrimethylammonium chloride which is applied to, adsorbed by or impregnated in the cellulosic material substrate. The resulting cellulosic material substrate is disclosed as being suitable for use in conventional washing machines for laundering clothes to eliminate random dyes from the wash and rinse waters, thereby eliminating undesirable discoloration of the clothes from fading of dyes from other clothes in the washing machine.

There is therefore known the use of a number of dye scavenger compounds, for example, quaternary ammonium compounds and tertiary polymeric amines, and polymers thereof, which are chemically affixed to a cellulosic material substrate for use in laundry machines for dye scavenging. The dye scavenger compounds disclosed in the aforementioned patents are incorporated herein by reference.

In Johnson, et al., U.S. Pat. No. 5,698,476 there is disclosed an article for removing extraneous, random free-flowing dyes from laundry washing applications. The laundry article includes two components, a dye absorber and a dye transfer inhibitor which are introduced into the wash water via a support matrix. The dye absorber is chemically attached to the support matrix to maintain a relational association during the laundry washing application. On the other hand, the dye transfer inhibitor is released from the support matrix into the wash water to be evenly distributed during the laundry washing application.

Materials disclosed in Johnson, et al. which are suitable as dye absorbers for the laundry article include quaternary N-substituted ammonium)-hydroxy-haloalkyl compounds such as 2-hydroxy-3-chloropropoyltrimethylammonium chloride; polyquaternary ammonium compounds; polyamphoterics; quaternized starches; proteins; chitin or its hydrolyzed form, chitosna; choline chloride; polyvinyl amine (PVAm); polyethylene imine (PEI); as well as combinations thereof. Dye transfer inhibitors include polyvinyl pyrrolidone, polyvinyl alcohol, polyvinyl imidazole, polyamine-N-oxides, cationic starches, magnesium aluminate, hydrotalcite, proteins, hydrolyzed proteins, polyethylene imines, polyvinyl oxazolidone, enzymes, oxidants, cationic surfactants, amphoteric surfactants, propylene oxide reaction products, polyamino acids, block co-polymers of alkylene oxides, polyamines, polyamides, methyl cellulose, carboxyalkyl, celluloses, guar gum, natural gums, alginic acid, polycarboxylic acids, cyclodextrins and mixtures thereof.

In order for a laundry article to be effective as a dye scavenger, it is required that the article be free to circulate within the washing machine to be exposed to the entire volume of wash and rinse waters. In the event the laundry article becomes trapped or commingled within the clothing, the article would only be exposed to a small portion of the wash or rinse waters. As a result, extraneous random dye within the wash or rinse waters would be free to redeposit on clothing items being laundered. This dye transfer can cause undesirable discoloration resulting in unsatisfactory appearance of clothing being laundered, particularly, when the clothes are of a different color than the random dye.

There is known from Dugger, et al., U.S. Pat. No. 4,026,131, a laundry additive dispenser which is removably attached to a laundry machine agitator. In Dugger, et al., a pouch is formed for receiving a laundry additive to be released during the rinse cycle of an automatic washing machine. By way of example, the disclosed additives can be bleaches, soil release finishers, rinsing aids, freshening aids, anti-bacterial agents, anti-static agents, anti-pilling agents, fabric strengthening agents, stain removal agents, water softening materials, anti-yellowing agents, etc. The dispenser is removably attached to the agitator of a washing machine by a rectangular top section having an enlarged opening. In an alternative embodiment, a pair of flexible strips are attached to the dispenser so as to tie the dispenser to the agitator. Other attachment examples are disclosed, for example, the use of wire, string, foil, water, impermeable glue or adhesive for attaching the dispenser to the agitator. The dispenser is operative during the rinse cycle only as the centrifugal force created during the spin cycle causes the dispenser to open via a rupturable seal thereby discharging its contents after the wash period.

There is also known from Baker, et al., U.S. Pat. No. 4,925,586, a water insoluble, water permeable pouch containing a detergent composition to be dispensed only during the wash cycle. The detergent composition may include other laundry aids such as bleach activators, flow aids, suds boosters, dyes, germacides, enzymes, chelating agents, etc. The pouch is releasably attached over the agitator by means of elongated strips which form a circular loop so as to be loosely fitted over the agitator. The detergent composition and/or other laundry aids dissolve out of the water permeable pouch by the force of the agitator and the wash water.

The laundry additive dispenser of Dugger, et al. and the pouch of Baker, et al. are not suitable for use as a dye scavenging article. In particular, as the dye scavenging compounds are water soluble, they must be chemically bonded to a support matrix to prevent their dissolving in the wash and rinse waters. On the other hand, the laundry additives and detergent compositions of Dugger, et al. and Baker, et al. rely upon their water solubility for dispensing during the rinse and wash cycles. Still further, the laundry additive dispenser of Dugger, et al. and detergent pouch of Baker, et al. are operative only for dispensing the laundry aids during a selected cycle during the laundry washing process, i.e., either the rinse cycle or the wash cycle. Thus, neither Baker, et al. nor Dugger, et al. provide for the treatment of both the wash and rinse waters for all cycles of the washing process.

In addition to the foregoing prior art, Haffner, et al., U.S. Pat. No. 3,212,303 disclose a hook for holding soiled articles in a water closet for cleaning. Clarke, et al., U.S. Pat. No. 4,348,293 disclose a water-permeable, water-insoluble bag containing a laundry aid such as a detergent powder for use in a washing machine. Hortel, et al., U.S. Pat. No. 4,740,326 disclose a single sheet, pouch or bag supporting a soil release polymer which contains a detergent and/or breaching composition. Mizusawa, et al., U.S. Pat. No. 4,882,917 disclose a wash additive article such as a fabric softener which is supported on top of the washing machine agitator for ejection into the rinse water during the high speed spinning of the agitator. Filapak, U.S. Pat. No. 3,670,530 and Bochan, U.S. Pat. No. 3,575,021, each disclose dispensers attached to the laundry machine agitator which are operative by the centrifugal force created during the spin cycle. Lucas, et al., U.S. Pat. No. 3,048,993 disclose a porous cotton bag which is initially attached to the laundry machine agitator and discharged into the wash water by the centrifugal force created during the spin cycle.

Notwithstanding the foregoing, there exists the need to develop a dye scavenging article for use in washing machines and the like which will prevent its being trapped and/or commingled with the clothing being washed during the entire laundry cycle, including both the wash and rinse cycles. In the absence of the laundry article being free to circulate within the washing machine so as to be exposed to the entire volume of wash and rinse waters, the article will be ineffective as a dye scavenger.

SUMMARY OF THE INVENTION

The present invention provides a dye scavenging article which is effective for scavenging random undesirable dye from the wash and rinse waters during the entire laundry washing cycle.

The present invention also provides a dye scavenging article which is maintained within an automatic washing machine to prevent the article from becoming trapped and/or commingled with the clothing during the entire laundry washing cycle.

The present invention also provides a dye scavenging article which is disposable after its intended use.

The present invention also provides a dye scavenging article to which there is chemically bonded a polyquaternary ammonium compound.

In accordance with one embodiment of the present invention there is disclosed an article for use in a washing machine operative for washing textile items in a liquid. The article includes a substrate material supporting a dye scavenging compound, and means for removably securing the substrate material within the washing machine during the operation thereof, whereby said substrate material is prevented from commingling with the items within the washing machine while exposing the dye scavenging compound to the liquid during the operation of the washing machine.

In accordance with another embodiment of the present invention there is disclosed an article for use in a washing machine operative for washing textile items in a liquid. The article includes a substrate material supporting a dye scavenging compound removably securable within the washing machine during the operation thereof, whereby the substrate material is prevented from commingling with the items within the washing machine while exposing the dye scavenging compound to the liquid during the operation of the washing machine.

In accordance with another embodiment of the present invention there is disclosed an article for use in a washing machine operative for washing textile items in a liquid. The article includes a substrate material supporting a dye scavenging compound, the substrate material constructed for preventing the substrate material from commingling with the items within the washing machine while exposing the dye scavenging compound to the liquid during the operation of the washing machine.

In accordance with another embodiment of the present invention there is disclosed a method for controlling random dye in a liquid containing textile items during the operation of a washing machine. The method includes the steps of placing in the liquid a dye scavenging article comprising a substrate material supporting a dye scavenging compound, maintaining the dye scavenging article in contact with the liquid during operation of the washing machine whereby the random dye within the liquid becomes associated with the dye scavenging compound, and preventing the dye scavenging article from commingling with the items within the washing machine during the operation thereof.

In accordance with another embodiment of the present invention there is disclosed a method for scavenging random dye in a liquid containing textile items of different colors which are the source of at least one random dye during the operation of a washing machine. The method includes the steps of releasably attaching a dye scavenging article to the washing machine, the dye scavenging article comprising a substrate material supporting a dye scavenging compound, whereby the dye scavenging article is prevented from commingling with the items within the washing machine during the operation thereof during at least a wash and rinse cycle of the washing machine, maintaining the dye scavenging article in continuous contact with the liquid within the washing machine during the operation thereof, whereby the at least one random dye within the liquid becomes associated with the dye scavenging compound to prevent the at least one random dye from becoming associated with the items during the operation of the washing machine.

BRIEF DESCRIPTION OF THE DRAWINGS

The above description, as well as further objects, features and advantages of the present invention will be more fully understood with reference to the following detailed description of a dye scavenging article, when taken in conjunction with the accompanying drawings, wherein.

DETAILED DESCRIPTION OF THE PREFERRED EMBODIMENTS

Figure 1:
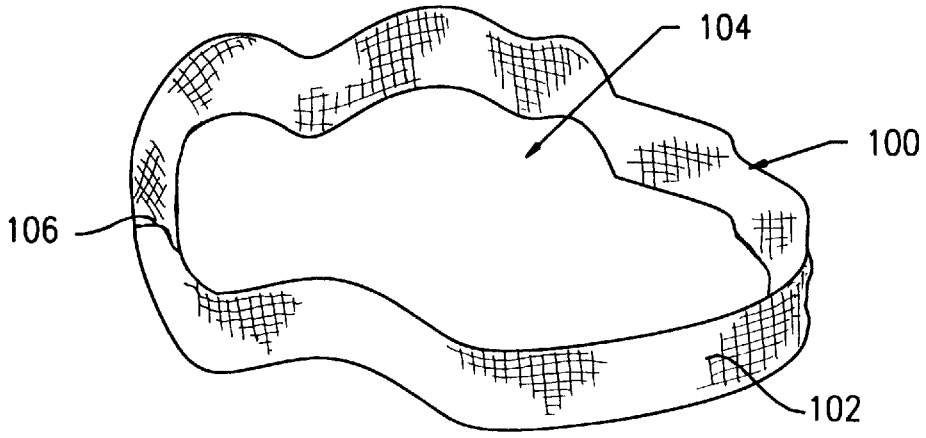
FIG. 1 is a perspective view of a dye scavenging article constructed in accordance with one embodiment of the present invention.

In accordance with the present invention, there is disclosed a dye scavenging article for use in conventional washing machines for laundering clothes to eliminate extraneous random dyes from both the wash and rinse waters thereby preventing discoloration of the clothes by fading of the dyes in the washing machine. The dye scavenging article generally includes two components, a substrate and a dye scavenger compound which is chemically bonded to the substrate.

Dye scavenging compounds found suitable for use in accordance with the preferred embodiment of the present invention comprise the general class of compounds known as polyquaternary ammonium compounds. In particular, the preferred compound comprises a quaternary salt of dimethylamine×epichlorohydrin having the general formula $(C_3H_5ClO.C_2H_7N)n$, and more specifically:

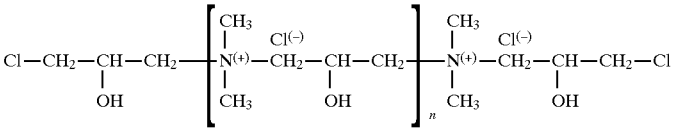

wherein n shows a polymerization degree and is a whole number in the range from about 10 to about 100. A polyquaternary ammonium compound of the above general formula is available from Clariant Corporation of Charlotte, N.C. under the trademark VRN. However, it is contemplated that the dye scavenging compounds disclosed in the aforementioned patents can also be chemically bonded to a substrate such as cellulosic materials for use in accordance with the present invention.

The substrate material for use in the present invention must be substantially water insoluble. In accordance with the preferred embodiment of the present invention, the substrate material will generally have anionic functional groups on its surface which are free to chemically react with the aforementioned dye scavenger compounds. Since these materials do not generally exist, it is necessary to chemically modify the surface of a suitable material to establish the requisite anionic groups. One type of functional group found on the surface of cellulosic materials is the hydroxyl group which can be converted to anionic functional groups. Exemplary cellulosic materials include rayon, cotton, in any of its forms, for example, purified cotton cellulose, cellulose sponge and the like. The substrate may further be provided in any physical form such as woven, non-woven, braided, knitted fabric or any other desirable configuration.

It should therefore be appreciated that the substrate of the present invention may comprise any desirable material , such as cellulosic material, polyurethane material and the like, to which a polyquaternary ammonium compound or other suitable dye scavenger compound can be attached, as well as taking any desirable form. Cellulosic material is preferred in view of its hydroxylated surface, as well as possessing sufficient web strength and sufficient abrasion strength to maintain its integrity as a dye scavenging article when used in a washing machine.

In accordance with one embodiment of the present invention, a polyquaternary ammonium compound, by way of example one having the general formula $(C_3H_5ClO.C_2H_7N)n$ is chemically attached to a cellulosic material substrate, and preferably a pure cotton towel having a large surface area. A method of chemically attaching the polyquaternary ammonium compound to the cellulosic material substrate is, for example, described in U.S. patent application Ser. No. 09/026,714 entitled "Method of Bonding a Polyquaternary Ammonium Compound to Cellulosic Material", filed on Feb. 20, 1998 in the name of James O. Threlkeld, which application is assigned to the assignee of the present application. The disclosure of the aforementioned U.S. Patent Application is incorporated herein by reference.

The disclosed method covalently bonds to a cellulosic material substrate a polyquaternary ammonium compound of the aforesaid general formula which exhibits dye scavenging properties for use in controlling extraneous undesirable random dye in a liquid bath containing a source of undesirable random dye and textile articles. By way of example, an aqueous solution containing the aforementioned quaternary ammonium compound is adjusted to a pH in the range of about 10 to about 12.5 using sodium hydroxide. A cellulosic material substrate is padded with the pH adjusted solution and subjected to heating at an elevated temperature in the range of about 100° C. to about 120° C. The cellulosic material substrate is held at temperature for about fifteen minutes to dry the substrate and to chemically bond the compound to the substrate. Any residual sodium hydroxide on the substrate is neutralized by placing the substrate in an aqueous bath containing an acid in sufficient amount to maintain the pH of the bath in the range of about 5–6.

Other suitable compounds for use as the dye scavenger and methods for attaching same to a substrate material are disclosed in the aforementioned U.S. patents, the disclosures of which are incorporated herein by reference, for example, chemically bonding polyquarternary ammonium compounds to polyurethane material as disclosed in U.S. Pat. No. 3,816,321.

Figure 2:
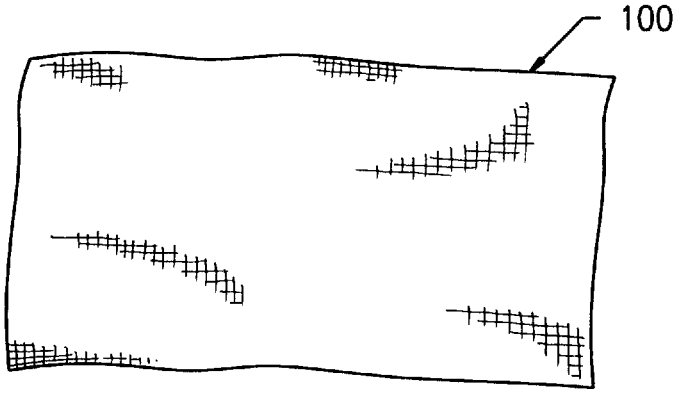
FIG. 2 is a front elevational view of a dye scavenging article constructed in accordance with another embodiment of the present invention.

Turning now to the drawings, wherein like reference numerals represent like elements, there is shown in FIG. 1 a perspective view of a dye scavenging article constructed in accordance with one embodiment of the present invention and generally designated by reference numeral 100. The article 100 of FIG. 1 is constructed in the shape of a continuous ring 102 defining an enlarged opening 104. As shown in FIG. 2, the dye scavenging article 100 can be constructed from a rectangular piece of cellulosic material to which a polyquaternary ammonium compound or other suitable dye scavenging material has been chemically attached thereto, for example, through absorption, adsorption, chemical reaction or other suitable means for adhering the water soluble compound thereto. The dye scavenging article 100 can be rolled or folded into an elongated shape such that its ends can be attached together as shown in FIG. 1. In addition, the dye scavenging article 100 can also be constructed as an elongated strip so as to avoid the necessity of folding or rolling. The elongated sheet or strip of cellulosic material may be secured at its free ends, such as by stitching generally designated by reference numeral 106. The ring 102 can also be formed, for example, where a sheet of cellulosic material is woven or knitted so as to form the continuous ring. In addition, the free ends of the ring 102 may be attached together by other suitable means, such as stapling, tying, adhesive bonding and the like. In forming the ring 102, it is also possible to provide elastic strips running throughout the dye scavenging article which will allow the opening 104 to expand and contract to aid in affixing the dye scavenging article 100 to, for example, the agitator of a washing machine.

Figure 3:
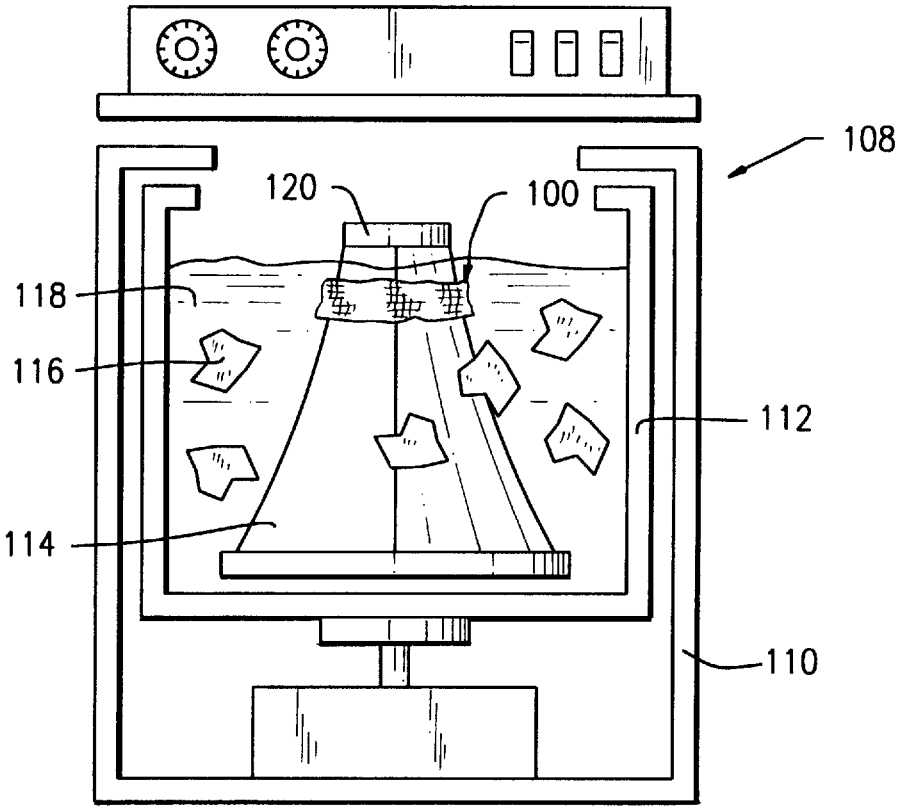
FIG. 3 is a front elevational view, in partial cross-section, showing an automatic laundry machine during use thereof with a dye scavenging article constructed in accordance with one embodiment of the present invention.

Referring now to FIG. 3, a conventional automatic washing machine 108 generally includes an outer housing 110 which rotationally supports an internal laundry tub 112. An agitator 114 is rotatably supported within the laundry tub 112 to effect agitation and commingling of the clothing items 116 within the wash and rinse waters 118 during the laundering process. It is to be understood that the washing machine 108, as thus far described, is merely exemplary of a washing machine for washing clothing items 116 during a laundry washing process having suitability for use with a dye scavenging article 100 constructed in accordance with the present invention. In this regard, as will become apparent from a further description of the construction and application of the dye scavenging articles 100 of the present invention, a washing machine 108 of the front loading type which eliminates an agitator 114 is also suitable for use with dye scavenging articles constructed in accordance with the present invention.

In use, a dye scavenging article 100, such as disclosed in FIG. 1 in the shape of a ring 102, is positioned about the agitator 114 by receiving the upper end of post 120 within the opening 104. The size of the opening 104 may be dimensioned so as to loosely receive the post 120. Alternatively, the size of the opening 104 may be constructed to receive the post 120 in friction fit by requiring that the dye scavenging article 100 be slightly stretched. Still alternatively, should the dye scavenging article 100 includes elastic fibers, the ring 102 will compress about the post 120 to provide a snug fit. In either cases, the dye scavenging article 100 by virtue of its inner facing portions forming the boundaries of the opening 104 holds the article in position within a central region of the laundry tub 112 by post 120 of the agitator 114. This prevents the dye scavenging article 100 from becoming trapped and/or commingled with the clothing items 116 during the entire washing cycle which includes both the wash and rinse cycles. Due to the turbulence created within the wash and rinse waters by the agitator 114, the entire volume of the wash and rinse waters are exposed to the dye scavenging article 100 so as to scavenge extraneous random dye which may be present as a result of the clothing items 116.

The dye scavenging article 100 is constructed in accordance with the present invention so as to preclude its being trapped and/or commingled with the clothing items 116 within the wash and rinse waters 118 during the laundering operation. As described with respect to FIG. 1, the dye scavenging article 100 is constructed in the shape of a ring having an opening 104 so as to be retained about the agitator 114 of the washing machine 108. However, it is to be understood that the dye scavenging article 100 can be constructed in other shapes and provided with other features which will preclude the dye scavenging article from becoming trapped and/or commingled with the clothing items 116.

Figure 4:
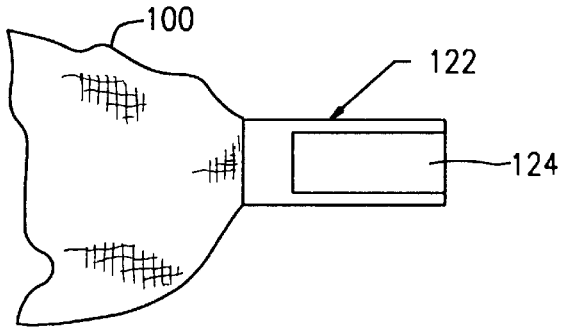
FIG. 4 is a partial view of a dye scavenging article having an assembly constructed in accordance with one embodiment of the present invention for removably attaching the dye scavenging article to a portion of a laundry machine.

Referring to FIG. 4, there is shown a portion of a dye scavenging article 100 which, as shown in FIG. 2, can be in the form of a rectangular or other shaped body of cellulosic material, e.g., oval, round, triangular, irregular and the like. Attached to at least one portion of the dye scavenging article 100 is a clip 122. The clip 122 may be constructed in a variety of configurations, all of which are adapted for releasably securing the dye scavenging article 100 to a portion of the washing machine 108. By way of illustration, the clip 122 will be releasably attachable to a portion of the agitator 114, a portion of the laundry tub 112 or a portion of the housing 110. In this regard, the dye scavenging article 100 will hang or extend into the laundry tub 112 so as to be in fluid contact with the wash and rinse waters 118 during the entire laundry operation. By virtue of the clip 122, the dye scavenging article 100 will be precluded from becoming trapped and/or commingled with the clothing items 116.

The clip 122 will typically include some form of clasp 124 which will resiliently engage a portion of the agitator 114, laundry tub 112 or housing 110. The clasp 124 will provide sufficient strength to prevent the dye scavenging article 100 from being pulled into the laundry tub 112 with the clothing items 116, such as by operation of the agitator 114, during the laundry process. As the clip 122 may be in contact with the wash and rinse waters, it is preferred that the clip be made of material such as plastic to prevent corrosion.

Figure 5:
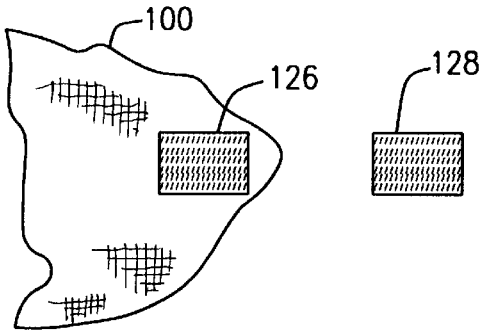
FIG. 5 is a partial view of a dye scavenging article having an assembly constructed in accordance with another embodiment of the present invention for removably attaching the dye scavenging article to a portion of a laundry machine.

Referring to FIG. 5, the dye scavenging article 100 incorporates Velcro® material including one component 126 attached to the cellulosic material and a second mating component 128. The mating component 128 may be attached to a portion of the interior of the washing machine 108 such as within the laundry tub 112 or to the agitator 114 using suitable means, such as an adhesive. The Velcro® material allows the dye scavenging article 100 to be removable yet secured when the components 126, 128 are mated.

Figure 6:
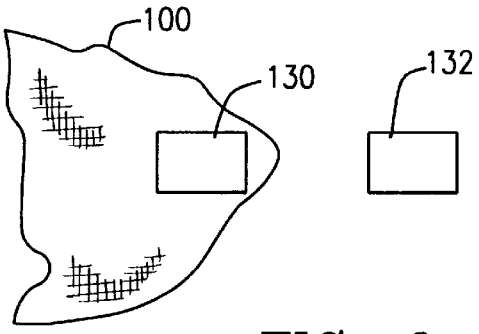
FIG. 6 is a partial view of a dye scavenging article having an assembly constructed in accordance with still another embodiment of the present invention for removably attaching the dye scavenging article to a portion of a laundry machine.

As shown in FIG. 6, a magnetic arrangement may be used for removably attaching the dye scavenging article 100 to the interior of the washing machine 108. For example, a magnet 130 may be attached to dye scavenging article 100, while a magnetizable metal 130 may be secured to the interior of the washing machine 108. The magnetizable material 130 can be constructed of a polymer base so as to prevent corrosion within the wash and rinse waters. Similarly, the magnetizable component 132 may be formed from a polymer base. In addition, either of the components 130, 132 may be attached to the dye scavenging article 100, the other component to the laundry tub 112, agitator 114 or housing 110.

Figure 7:
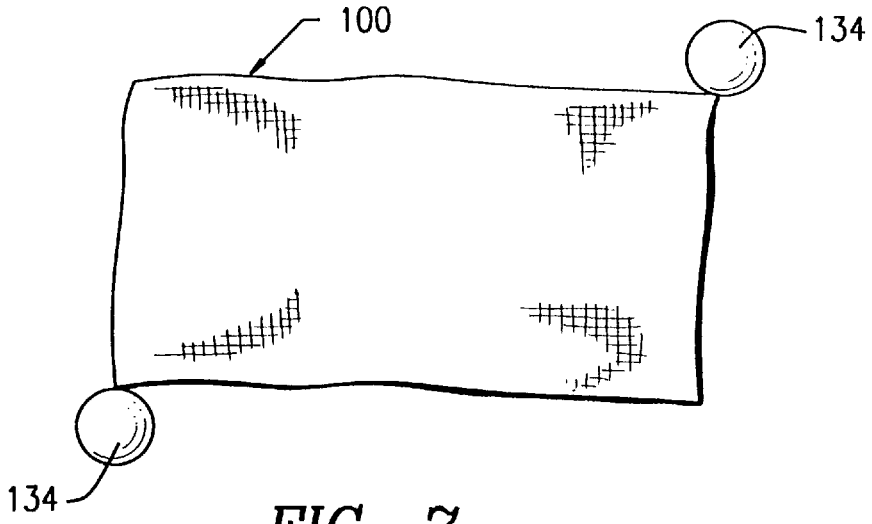
FIG. 7 is a partial view of a dye scavenging article having an assembly constructed in accordance with still another embodiment of the present invention for removably attaching the dye scavenging article to a portion of a laundry machine.

Referring to FIG. 7, the dye scavenging article 100 includes, at least one, and preferably two or more flotation balls 134. The flotation balls 134 have a tendency to keep the dye scavenging article 100 within the upper layers of the rinse and wash waters due to their buoyancy to prevent the article from being pulled down by operation of the agitator 114 to become trapped or commingled with the clothing items 116 being washed. The flotation balls 134 may be of any construction, for example, hollow plastic balls, Styrofoam balls, or any other suitable body which will be buoyant so as to float within the wash and rinse waters.

Figure 8:
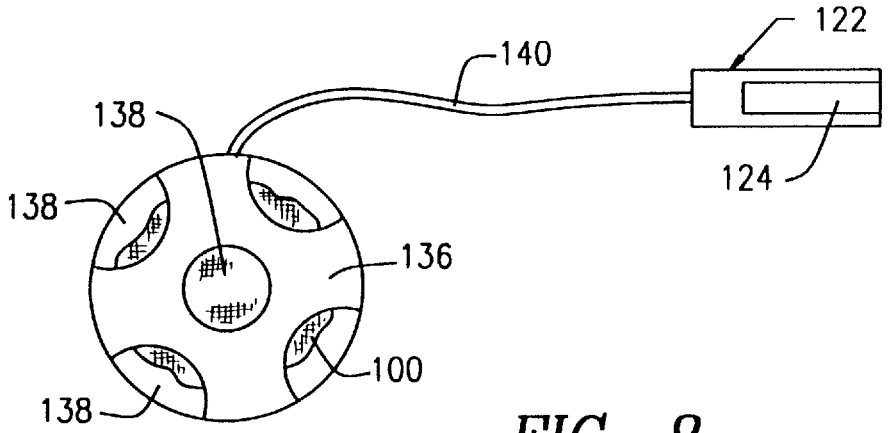
FIG. 8 is a partial view of a dye scavenging article having an assembly constructed in accordance with still another embodiment of the present invention for removably attaching the dye scavenging article to a portion of a laundry machine.

Turning to FIG. 8, a dye scavenging article 100 is positioned within a hollow ball 136 having a plurality of enlarged openings 138. The openings 138 allow the wash and rinse waters to freely flow through the ball 136 so as to be exposed to the dye scavenging article 100. The ball 136 may desirably be attached to the washing machine 106 using a suitable clasp 122 which is tethered to the ball by means of a rope 140.

Figure 9:
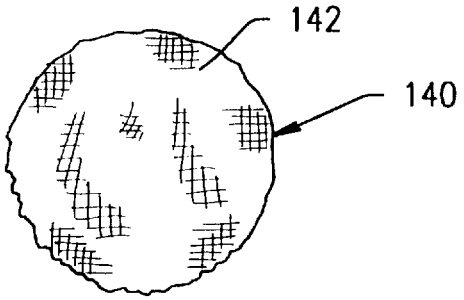
FIG. 9 is a partial view of a dye scavenging article having an assembly constructed in accordance with still another embodiment of the present invention for removably attaching the dye scavenging article to a portion of a laundry machine.

Turning to FIG. 9, a dye scavenging article 140 includes a cellulosic material 142 to which there is chemically bonded a polyquarternary ammonium compound. The cellulosic material 142 is covered over a flotation ball 134 (not shown). The flotation ball will be of sufficient size to prevent its entrapment or commingling with the clothing items being laundered. In addition, the dye scavenging article 140 can be tethered as previously described with respect to FIG. 8.

Figure 10:
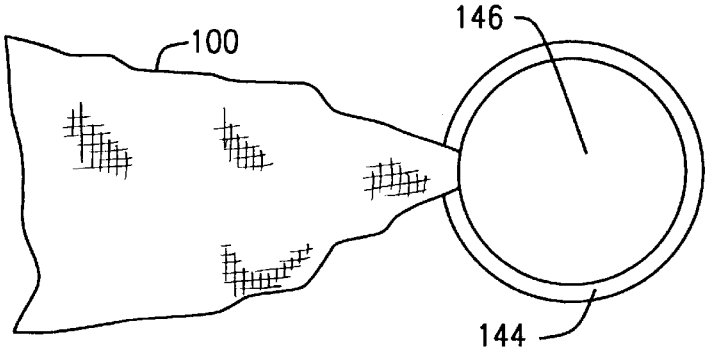
FIG. 10 is a partial view of a dye scavenging article having an assembly constructed in accordance with still another embodiment of the present invention for removably attaching the dye scavenging article to a portion of a laundry machine.

Turning to FIG. 10, a dye scavenging article 100 is attached to a ring 144, preferably of plastic material, having an enlarged opening 146. The ring may be placed over the post 120 of a washing machine agitator 114 in a similar manner to ring 102 as shown in FIG. 3.

The dye scavenging article 100 of the present invention may be constructed in a variety of shapes and forms for use in scavenging extraneous dye during a laundry process for dyed textile articles and the like. In this regard, the dye scavenging article includes a support matrix, for example, a cellulosic material, polyurethane, and the like to which there is affixed a dye scavenging compound. Preferably, the dye scavenging article comprises a cellulosic substrate to which there is chemically attached a polyquaternary ammonium compound.

In order to be the most effective, it is a requirement that the dye scavenging article 100 be freely exposed to the entire volume of wash and rinse waters during the entire laundry process. To this end, the construction of the dye scavenging article 100 should preclude its entrapment or commingle-ment with the clothing items being laundered. In accordance with the various described embodiments, the dye scavenging article can be constructed in the shape of a ring which can be placed over an agitator of the washing machine to prevent its entrapment or commingle-ment with the clothing items being washed. In addition, various clips and other devices may be used, such as Velcro® material, magnetizable materials, flotation devices, and the like to keep the dye scavenging article 100 free from the clothing items. These latter embodiments are particularly suitable to washing machines which do not include an agitator, such as front loading machines. Still further, the dye scavenging article 100 may be provided with suitable adhesives, ropes, wires, elongated strips extending from the article and the like for attaching same to a portion of the washing machine, for example, the agitator 114.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An article for use in a washing machine operative for washing textile items in a liquid, said article comprising a substrate material supporting a dye scavenging compound, and means for removably securing said substrate material within said washing machine during the operation thereof, whereby said substrate material is substantially prevented from commingling with said items within said washing machine while exposing said dye scavenging compound to said liquid during the operation of said washing machine.

2. The article of claim 1, wherein said substrate material comprises cellulosic material.

3. The article of claim 2, wherein said dye scavenging compound is chemically attached to said substrate material.

4. The article of claim 1, wherein said substrate material is in the shape of a continuous ring.

5. The article of claim 1, wherein said substrate material is in the form of a rectangular sheet.

6. An article for use in a washing machine operative for washing textile items in a liquid, said article comprising a substrate material supporting a dye scavenging compound removably securable within said washing machine during the operation thereof, whereby said substrate material is substantially prevented from commingling with said items within said washing machine while exposing said dye scavenging compound to said liquid during the operation of said washing machine.

7. The article of claim 6, wherein said substrate material includes a ring attached thereto.

8. The article of claim 6, wherein said substrate material includes a clip having one portion attached to said substrate material and another portion removably attachable to the washing machine.

9. The article of claim 6, wherein said substrate material includes Velcro® fastening material comprises a first element attached to said substrate material and a second element attached to the washing machine, said first and second elements being releasably attachable to each other.

10. The article of claim 6, wherein said substrate material comprises cellulosic material.

11. The article of claim 6, wherein said substrate material is in the shape of a continuous ring.

12. The article of claim 11, wherein a portion of said substrate material forming the shape of said continuous ring provides an opening.

13. The article of claim 12, wherein said opening is operative for receiving a portion of said washing machine therein.

14. An article for use in a washing machine operative for washing textile items in a liquid, said article comprising a substrate material supporting a dye scavenging compound, said substrate material constructed for preventing said substrate material from substantially commingling with said items within said washing machine while exposing said dye scavenging compound to said liquid during the operation of said washing machine.

15. The article of claim 14, wherein said substrate material comprises cellulosic material.

16. The article of claim 15, wherein said dye scavenging compound is chemically attached to said substrate material.

17. The article of claim 14, wherein said substrate material is in the shape of a continuous ring.

18. The article of claim 14, wherein said substrate material is in the form of a rectangular sheet.

19. The article of claim 14, wherein said substrate material is constructed to be releasably attached to an agitator of said washing machine.

20. The article of claim 14, wherein said substrate material is constructed to include a clip for releasably attaching said substrate material to said washing machine.

21. The article of claim 14, wherein said substrate material is constructed to include Velcro® fastening material.

22. The article of claim 21, wherein said Velcro® fastening material comprises a first element attached to said substrate material and a second element attached to the washing machine, said first and second elements being releasably attachable to each other.

23. The article of claim 14, wherein said substrate material is constructed to have a portion thereof releasably attachable to said washing machine.

24. A method for controlling random dye in a liquid containing textile items during the operation of a washing machine, said method comprising the steps of placing in said liquid a dye scavenging article comprising a substrate material supporting a dye scavenging compound, maintaining said dye scavenging article in substantial contact with said liquid during operation of said washing machine whereby said random dye within said liquid becomes associated with said dye scavenging compound, and preventing said dye scavenging article from commingling with said items within said washing machine during the operation thereof.

25. The method of claim 24, wherein said substrate material comprises cellulosic material.

26. The method of claim 25, further including the step of chemically attaching said dye scavenging compound to said cellulosic material.

27. The method of claim 26, wherein said preventing step comprises releasably attaching said dye scavenging article to an agitator within said washing machine.

28. The method of claim 24, wherein said liquid comprises at least the wash and rinse waters of said washing machine.

29. The method of claim 24, wherein said maintain step comprises suspending said dye scavenging article within said washing machine in a location wherein said dye scavenging compound will be exposed substantially continuously to said liquid during the operation of said washing machine.

30. The method of claim 24, wherein said preventing step comprises releasably attaching said dye scavenging article within said washing machine.

31. The method of claim 30, wherein said releasably attaching step comprises forming said dye scavenging article into the shape of a continuous ring, and placing said ring over a portion of said washing machine.

32. The method of claim 30, wherein said releasably attaching step comprises providing said substrate material with a clip, said clip releasably engaging a portion of said washing machine.

33. The method of claim 30, wherein said releasably attaching step comprises providing said substrate material with Velcro® fastening material.

34. The method of claim 33, wherein said Velcro® fastening material comprises a first element attached to said substrate material and a second element attached to the washing machine, said first and second elements being releasably attachable to each other.

35. The method of claim 30, wherein said releasably attaching step comprises providing said substrate material with magnetic material releasably attachable to said washing machine.

36. The method of claim 24, wherein said preventing step comprises preventing said dye scavenging article from becoming trapped with said items within said washing machine.

37. A method for scavenging random dye in a liquid containing textile items of different colors which are the source of at least one random dye during the operation of a washing machine, said method comprising the steps of releasably attaching a dye scavenging article within said washing machine whereby said dye scavenging article is prevented from commingling with said items within said washing machine during the operation thereof during at least a wash and rinse cycle of said washing machine, said dye scavenging article comprising a substrate material supporting a dye scavenging compound, maintaining said dye scavenging article in substantially continuous contact with said liquid within said washing machine during the operation thereof, whereby said at least one random dye within said liquid becomes associated with said dye scavenging compound to prevent said at least one random dye from becoming associated with said items during the operation of said washing machine.

38. The method of claim 37, wherein said substrate material comprises cellulosic material.

39. The method of claim 38, further including the step of chemically attaching said dye scavenging compound to said cellulosic material.

40. The method of claim 38, wherein said releasably attaching step comprises providing said dye scavenging article in the shape of a ring, and placing said dye scavenging article over an agitator of said washing machine.

41. The method of claim 37, wherein said maintain step comprises suspending said dye scavenging article within said washing machine in a location wherein said dye scavenging compound will be exposed continuously to said liquid during the operation of said washing machine.

42. The method of claim 37, wherein said releasably attaching step comprises forming said dye scavenging article into the shape of a continuous ring, and placing said ring over a portion of said washing machine.

43. The method of claim 37, wherein said releasably attaching step comprises providing said substrate material with a clip, said clip releasably engaging a portion of said washing machine.

44. The method of claim 37, wherein said releasably attaching step comprises providing said substrate material with Velcro® fastening material.

45. The method of claim 44, wherein said Velcro® fastening material comprises a first element attached to said substrate material and a second element attached to the washing machine, said first and second elements being releasably attachable to each other.

46. The method of claim 37, wherein said releasably attaching step comprises providing said substrate material with magnetic material releasably attachable to said washing machine.

47. The method of claim 37, wherein said releasably attaching step prevents said dye scavenging article from becoming trapped within said items within said washing machine.

* * * * *